United States Patent [19]

Jacobs et al.

[11] 4,223,247

[45] Sep. 16, 1980

[54] METAL VAPOR DISCHARGE LAMP

[75] Inventors: Cornelis A. J. Jacobs; Jaap Rozenboom, both of Eindhoven, Netherlands

[73] Assignee: U.S. Philips Corporation, New York, N.Y.

[21] Appl. No.: 11,023

[22] Filed: Feb. 12, 1979

Related U.S. Application Data

[63] Continuation of Ser. No. 788,448, Apr. 18, 1977, abandoned.

[30] Foreign Application Priority Data

May 5, 1976 [NL] Netherlands ..... 7604760

[51] Int. Cl.[2] ..... H05B 41/19; H01J 17/34

[52] U.S. Cl. ..... 315/57; 315/60; 315/70; 315/73; 315/262

[58] Field of Search ..... 315/241 R, 60, 70, 73, 315/57, 234, 239, 240, 262, 263, 290

[56] References Cited

U.S. PATENT DOCUMENTS

| | | | |
|---|---|---|---|
| 3,859,562 | 1/1975 | Nakamura | 315/241 R |
| 3,900,753 | 8/1975 | Richardson | 313/198 |
| 4,037,129 | 7/1977 | Zack et al. | 315/73 X |

FOREIGN PATENT DOCUMENTS

| | | | |
|---|---|---|---|
| 1539476 | 2/1970 | Fed. Rep. of Germany . | |
| 809086 | 12/1936 | France | 315/57 |
| 1343780 | 1/1974 | United Kingdom | 315/73 |

*Primary Examiner*—Eugene R. LaRoche
*Attorney, Agent, or Firm*—Robert S. Smith

[57] ABSTRACT

The invention relates to a high-pressure sodium vapor discharge lamp which comprises a discharge tube provided with an external starting electrode. In accordance with the invention the lamp comprises a transformer wherein the secondary winding of the transformer is connected between the starting electrode and a main electrode of the discharge tube, the primary winding of that transformer being included in an oscillatory circuit including a glow starter. These further components of the starting circuit form part of the lamp. In this construction proper starting of the lamp is achieved with minimal insulation near the input terminals of the lamp.

4 Claims, 2 Drawing Figures

METAL VAPOR DISCHARGE LAMP

Figure 1:
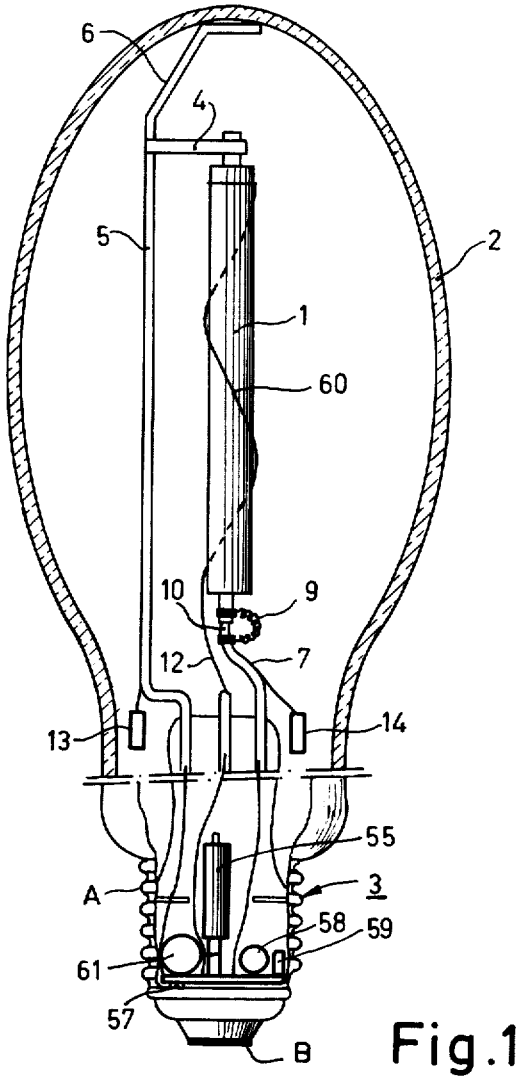

This is a continuation of application Ser. No. 788,448, filed Apr. 18, 1977 now abandoned.

The invention relates to a metal vapour discharge lamp for operation with an AC power supply, comprising a discharge tube and an outer bulb enveloping this tube, the discharge tube being provided at each end with a respective internal main electrode and an external starting electrode which is connected to one of the main electrodes via a circuit element forming part of the lamp.

A known lamp of the type described is, for example, described in U.S. Pat. No. 3,900,753. With that prior art lamp the circuit element between the starting electrode and one of the main electrodes is a bi-metal element. A disadvantage of that prior art lamp is that the peak voltage during starting of the lamp is relatively low between the starter electrode and the other—the second—main electrode. This means that the voltage to be applied between the main electrodes for starting of the lamp should be relatively high. Consequently this high voltage must be taken into account as regards the insulation of the input terminals of the lamp.

It is true that, by altering, for example, the geometry of the discharge tube or the filling gas in that tube, the required voltage could be reduced but this clashes with other lamp requirements such as, for example, those concerning the luminous efficacy (lumens per Watt).

It is an object of the invention to provide a metal vapour discharge lamp of the type described which can be started with a relatively low voltage between the main electrodes without an attendant considerable decrease in the luminous efficacy of the lamp.

A metal vapour discharge lamp according to the invention, for operation with an a.c. power supply comprising a discharge tube and an outer bulb enveloping this tube, the discharge tube being provided at each ends with a respective internal main electrode and an external starting electrode which is connected to one of the main electrodes via a circuit element forming part of the lamp, is characterized in that the circuit element is a secondary winding of a transformer, and a primary winding of the transformer is included in an electric connection which is in parallel with the discharge path between the main electrodes and, at least during starting of the lamp, the transformer windings are connected such that the peak voltage between the starting electrode and the second main electrode is increased by means of the transformer.

An advantage of a metal vapour discharge lamp according to the invention is that the voltage required between the main electrodes for starting of the lamp may be relatively low. This results from the fact that the voltage at the starting electrode is now of a sufficiently high value to start the lamp and a lower voltage between the main electrodes will suffice for operating the lamp. As the secondary winding of the transformer forms part of the lamp, the electrical insulation between the input terminals of the lamp need not be so high.

The measure according to the invention for obtaining, by means of the secondary transformer winding, an increased starting voltage at the starting electrode of the lamp need of course not be to the detriment of the luminous efficacy of the lamp since the measure according to the invention does not affect the interior of the discharge tube.

A lamp according to the invention may, for example, be a low-pressure discharge lamp. It may alternatively be a high-pressure discharge lamp, for example a high-pressure mercury vapour discharge lamp or a high-pressure sodium vapour discharge lamp.

The primary winding of the transformer may, for example, be disposed outside the outer bulb of the lamp according to the invention, wherein this primary winding must of course be arranged such that it is magnetically coupled to the secondary windings inside the bulb.

The primary winding may, for example, be supplied with an electric supply of the same frequency as that which is applied between the main electrodes.

In a preferred embodiment of a metal vapour discharge lamp according to the invention the primary winding of the transformer is part of a frequency-increasing auxiliary device.

An advantage of this preferred embodiment is that a control signal can be applied to the starting electrode of the lamp which signal further promotes starting owing to the relatively higher frequency.

The frequency-increasing auxiliary device may, for example, be designed as a transistorized a.c.-a.c. voltage convertor.

In a further improvement of the last-mentioned preferred embodiment the frequency-increasing auxiliary device is designed as follows: the primary winding of the transformer is shunted by a series arrangement of a first capacitor and a switch comprising a starting discharge tube, a resistor being included in series with the primary winding of the transformer and its shunting circuit.

An advantage of this further improvement is that the entire starting circuit of the lamp may be very simple. With this starting circuit the capacitor is then first charged via the resistor, this capacitor abruptly discharging thereafter via the switch and the primary winding of the transformer. The voltage induced thereby in the secondary winding of the transformer is fed to the starting electrode of the lamp.

The above-mentioned switch which is designed as a discharge tube may, for example, be a voltage breakdown component.

In a further preferred embodiment of a metal vapour discharge lamp according to the invention the switch is a glow discharge starter tube provided with a bimetal contact.

An advantage of this preferred embodiment is that both closing and interrupting the current in the auxiliary circuit (primary winding, capacitor, and switch) takes place very rapidly so that—by means of the transformer—high voltage peaks are produced.

In a further preferred embodiment of a metal vapour discharge lamp according to the invention the primary and the secondary windings of the transformer are electrically interconnected and one electrode of the first capacitor is connected to that connection; the other electrode of that first capacitor being connected to the first main electrode of the discharge tube and thus forming part of the connection from the starting electrode—via the secondary transformer winding—to the first main electrode.

An advantage of this preferred embodiment is that a very simple, reliably-operating starting device of the lamp can be obtained. It should be noted that a somewhat similar starting circuit is known per se from German Pat. No. 1,199,399. However, with that prior art circuit the secondary winding of the transformer does not form part of the lamp so that relatively high requirements as regards insulation at the input terminals of the lamp must be imposed.

The secondary winding of the transformer may, for example, be directly connected to the starting electrode of the lamp.

In a further preferred embodiment of a metal vapour discharge lamp according to the invention a second capacitor is connected between the starting electrode and the secondary winding of the transformer.

An advantage of this preferred embodiment is that electrolysis—as regards the metal in the discharge tube—at the wall of the discharge tube, near the starting electrode is countered.

The dielectric of the second capacitor may, for example, be constituted by a glass component of the lamp, for example by the so-called stem tube. Disposed at either side of that stem tube there are then electrically-conducting layers which represent the capacitor electrodes. An advantage of this construction is that this "feed-through capacitor" is highly gastight.

In a further preferred embodiment of a discharge lamp according to the invention the resistor in series with the primary winding of the transformer is a resistor having a positive temperature coefficient, that is to say it is a so-called P.T.C. resistor.

An advantage of the last-mentioned preferred embodiment is that, in the conducting state of the switch, the heat generation in the resistor remains limited.

It is of course alternatively possible to realize said last preferred embodiment by means of a series arrangement of a linear resistor and a temperature-dependent P.T.C. resistor.

Preferably the electric circuit which is in parallel with the discharge path is disposed between the main electrodes—as well as the primary winding of the transformer forming part of that electric circuit—are disposed within the assembly of outer bulb and base of the lamp.

An advantage of this device is that therewith a lamp can be obtained wherein the entire starting circuit forms part of the lamp. In that case no additional external starter, for example a thyristor starter as described in United Kingdom Pat. No. 1,300,214, is required.

The starting circuit may, for example be disposed for the greater part in the base of the lamp. Alternatively, a plurality of components of the starting circuit, for example the glow discharge starter and the transformer, may be disposed within the outer bulb of the lamp.

Figure 2:
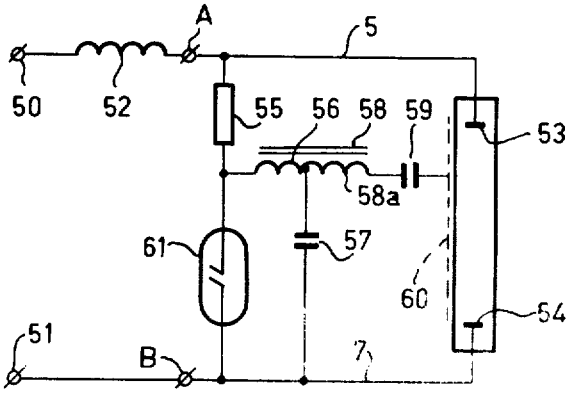

An embodiment of the invention will now be described, by way of example, with reference to the accompanying drawing, in which:

FIG. 1 shows an elevational view of a high pressure sodium vapour discharge lamp according to the invention wherein an outer bulb is only partly shown, and FIG. 2 shows the lamp of FIG. 1 in a diagrammatical representation as well as the circuit thereof.

In FIG. 1 a discharge tube 1 is enveloped by an outer bulb 2 provided with a base 3.

The overall length of the lamp is approximately 28 cm. The largest width of the outer bulb 2 is approximately 12 cm. The power of the lamp is approximately 400 Watts.

The end of the tube 1 which faces away from the base 3 is fastened to a supply strip 4. In its turn this strip is fastened to an electric supply conductor 5. An extension 6 of the supply conductor 5 serves for supporting and centering of the discharge tube 1 in the outer bulb 2. Furthermore the supply conductor 5 is electrically connected to a contact A formed by the threaded outer circumference of the base 3.

The end of the discharge tube 1 which faces the base 3 is connected to an electric supply conductor 7 which leads to a center contact B of the base 3. An electrical connection 9 is used for the current supply. A component 10, in alignment with the conductor 7, only has a supporting function, namely a flexible bearing for the tube 1.

Reference 60 (see also FIG. 2) indicates a starting electrode which is spirally wound around the tube 1. Via a feedthrough conductor 12 this electrode 60 is connected electrically to a component in the lamp base 3. Ring getters 13 and 14 are provided for maintaining the vacuum between the tube 1 and the outer bulb 2. In the lamp base 3 there is disposed a starting auxiliary device consisting of a resistor 55, a transformer 58, a first capacitor 57, a second capacitor 59 and a flow starter 61. FIG. 2 shows the electrical connection of that auxiliary starting device to the discharge tube.

In FIG. 2 reference 50 is an input terminal which, together with a terminal 51, is intended for connection to an a.c. voltage source of approximately 220 V, 50 Hz. Terminal 50 is connected to one terminal of an inductive stabilization ballast 52. The other terminal of the ballast 52 is connected, to a main electrode 53 of the discharge tube 1 of the lamp of FIG. 1. Another main electrode 54 of this discharge tube is connected to the input terminal 51. The discharge tube is shunted by a series arrangement of the resistor 55, which, has a positive temperature coefficient, a primary winding 56 of transformer 58 and a first capacitor 57. Reference 58*a*, indicates a secondary winding of the transformer 58. One end of this winding 58*a* is connected to a junction between the winding 56 and the capacitor 57. The other end of the winding 58*a* is connected via the second capacitor 59 to the starting electrode 60 of the discharge tube. One terminal of glow starter 61 is connected to the junction point of the resistor 55 and the primary winding 56 of the transformer. The other terminal of this glow starter 61 is connected to the input terminal 51.

The arrangement of FIG. 2 operates as follows: if a voltage of 220 V, 50 Hz is connected between the terminals 50 and 51, the capacitor 57 is charged through the circuit 50, 52, A, 55, 56, 57, B, 51. At the same time the glow starter 61 starts glowing which causes its contacts to approach one another. After some time the heat production in glow starter 61 is such that in that starter the contacts contact one another. Thereafter the capacitor 57 discharges abruptly via the primary winding 56 of the transformer. This produces high frequency voltage pulses due to the oscillatory circuits formed by transformer 58 and capacitor 57 in winding 58, which produces between the control (starting) electrode 60 and the main electrode 54 of the discharge tube. Shortly thereafter the contacts of the glow starter 61 will have cooled again so that these contacts open. This results once more in high frequency voltage peaks owing to the fact that the capacitor 57 is connected into the circuit again. If the lamp does not start at the first voltage peak, the above procedure repeats itself.

The circuit elements 55, 56, 57, 58*a*, 59 and 61 are—as also appears from FIG. 1—part of the lamp. This means that the voltage between the input terminals A and B is low relative to the starting voltage so that the insulation of these terminals need only be dimensioned for a relatively low electric voltage.

In a practical embodiment, the self-inductance of the ballast 52 is approximately 0.13 Henry. The discharge lamp is—as observed above—a high-pressure sodium vapour discharge lamp for approximately 400 Watts. The luminous flux is approximately 5000 lumens. The resistance 55 has at room temperature (approximately 25° C.) an ohmic value of approximately 1.8 kΩ. At 200° C. the ohmic value of that resistor 55 exceeds 10 kΩ. The transformation ratio of the transformer **56–58*a* is 1 to 35. The capacitor 59 has a capacitance of approximately 100 pico Farad. The capacitor 57** a capacitance of approximately 10 nanoFarad.

A great advantage of the lamp according to the invention is that it requires no external electronic starter and need only satisfy relatively low requirements as regards insulation at the input terminals of the lamp, and yet it has a relatively large luminous efficacy of approximately 125 lumens/Watt.

In a second embodiment of a lamp according to the invention the glow discharge starter 61 is for example present in the place of the resistor 55. In that embodiment the capacitors 57 and 59 can be replaced by low ohmic connections. Thereby the discharge tube, provided with the electrodes 53 and 54, can be shunted by a capacitor.

What is claimed is:

1. A metal vapor discharge lamp, for operation with an associated A.C. voltage supply, which comprises:

a discharge tube;

an outer bulb enveloping said discharge tube;

a base engaging said envelope in a gas tight manner;

first and second internal main electrodes disposed respectively at each end of said discharge tube;

an external starting electrode proximate to at least an axial portion of said discharge tube;

a transformer disposed within the space enclosed by said envelope and said base having a primary winding and a secondary winding said secondary winding being connected to said first main electrode and said primary winding of the transformer being included in an electric circuit which is in parallel with the discharge path between said main electrodes, and at least during starting of the lamp, said transformer windings being connected such that the peak voltage between said starting electrode and said second main electrode is increased by means of said transformer and means for increasing frequency which includes said primary winding and said electric circuit.

2. The apparatus as described in claim 1 wherein said means for increasing frequency is a first capacitor, a switch and a resistor, said primary winding of said transformer being shunted by a series arrangement of said first capacitor and said switch comprising a glow discharge tube and a bimetal operated contact, said resistor being connected in series with the parallel connection formed by said primary winding of said transformer and said series arrangement of said first capacitor and said switch, said primary winding and said secondary winding of said transformer being interconnected and one electrode of said first capacitor being connected to that interconnection, the other electrode of said first capacitor being connected to said first main electrode of said discharge tube and, consequently, forming part of the connection from said starting electrode via the secondary transformer winding to said first main electrode.

3. A metal vapor discharge lamp as claimed in claim 2 further including a second capacitor connected between said starting electrode and said secondary winding of said transformer, and wherein said resistor has a positive temperature coefficient.

4. A metal vapor discharge lamp as claimed in claim 3 wherein said electric circuit which is in parallel with the discharge path between said main electrodes, as well as said primary winding of said transformer forming part of said electric circuit, are disposed within the space enclosed by the assembly of said envelope and said base.

* * * * *